US005929621A

United States Patent [19]

Angelici et al.

[11] Patent Number: 5,929,621

[45] Date of Patent: Jul. 27, 1999

[54] GENERATION OF TEMPERATURE COMPENSATED LOW NOISE SYMMETRICAL REFERENCE VOLTAGES

[75] Inventors: Marco Angelici, Galliate Lombardo; Sandro Dalle Feste, Novara; Nadia Serina, Castelcovati; Marco Bianchessi, Sergnano, all of Italy

[73] Assignee: STMicroelectronics S.r.L., Agrate Brianza, Italy

[21] Appl. No.: 09/175,161

[22] Filed: Oct. 19, 1998

[30] Foreign Application Priority Data

Oct. 23, 1997 [EP] European Pat. Off. ..... 97830534

[51] Int. Cl.[6] ..... G05F 3/16

[52] U.S. Cl. ..... 323/313; 323/315; 323/316; 323/907

[58] Field of Search ..... 323/312, 313, 323/314, 315, 316, 907; 363/73

[56] References Cited

U.S. PATENT DOCUMENTS

| | | | |
|---|---|---|---|
| 4,853,610 | 8/1989 | Schade, Jr. | 323/316 |
| 4,866,312 | 9/1989 | Kearney et al. | 307/496 |
| 5,103,159 | 4/1992 | Breugnot et al. | 323/315 |
| 5,237,262 | 8/1993 | Ashley et al. | 323/284 |
| 5,349,284 | 9/1994 | Whittle | 323/207 |
| 5,352,973 | 10/1994 | Audy | 323/313 |
| 5,359,298 | 10/1994 | Abe | 331/2 |
| 5,508,604 | 4/1996 | Keeth | 323/314 |
| 5,545,978 | 8/1996 | Pontius | 323/313 |
| 5,686,821 | 11/1997 | Brokaw | 323/273 |
| 5,754,039 | 5/1998 | Nishimura | 323/315 |

FOREIGN PATENT DOCUMENTS

| | | | |
|---|---|---|---|
| 0 740 243 A2 | 10/1996 | European Pat. Off. | G05F 1/56 |
| 0 740 243 A3 | 10/1996 | European Pat. Off. | G05F 1/56 |
| WO 97/20262 | 6/1997 | WIPO | G05F 1/10 |

OTHER PUBLICATIONS

Kumwachara et al., "An Accurate CMOS Differential Voltage–to–Current Converter," International Journal of Electronics, vol. 77, No. 6, Dec. 1, 1994, pp. 1025–1033.

*Primary Examiner*—Adolf Deneke Berhane
*Attorney, Agent, or Firm*—Allen, Dyer, Doppelt, Milbrath & Gilchrist, P.A.

[57] ABSTRACT

Generation of symmetrical temperature compensated reference voltages in mixed type integrated circuits (digital and analog) having a superior PSRR is provided. Such a circuit includes a voltage-to-current conversion stage of a temperature independent bandgap voltage for producing a differential pair of currents that are applied as inputs to a pair of resistor feedback operational amplifiers. The feedback resistors are integrated in an interlaced form with a resistor employed in the conversion stage so that they have the same thermal gradient. Output of the operational amplifiers provides two temperature compensated low noise symmetrical reference voltages.

23 Claims, 2 Drawing Sheets

GENERATION OF TEMPERATURE COMPENSATED LOW NOISE SYMMETRICAL REFERENCE VOLTAGES

FIELD OF THE INVENTION

The present invention relates to the field of circuits, and more particularly, to Sigma-Delta analog/digital and digital/analog converter circuits.

BACKGROUND OF THE INVENTION

Some applications require the generation of reference voltages which are thermally compensated and have low noise. These reference voltages are typically symmetrical about an analog (VCC/2) ground. An example application is a switched-capacitor integrated circuit used in a Sigma-Delta converter.

FIG. 1 illustrates a circuit diagram of a prior art second order Sigma-Delta modulator for an analog/digital converter (A/D). VH and VL are reference voltages that define a maximum input dynamic range for the system.

FIG. 2 illustrates a switched-capacitor biquadratic cell for filtering a digital bit stream in a prior art Sigma-Delta digital/analog converter (D/A). Depending on the logical value of the bit stream ('1' or '0'), a positive voltage (VH) or a negative voltage (VL) is applied. These voltages are generated with respect to the input analog reference potential (analog ground) of the filter.

In both applications, as shown in FIGS. 1 and 2, performance of the respective A/D and D/A converters depends upon the "quality" of these reference voltages VH and VL. For instance, a noise superimposed on these voltages is translated into an error of the charge stored in the input capacitances, and hence, on the integrated value at the output of the two structures. This in turn limits the signal-to-noise ratio of these devices. Current high resolution audio converters use reference voltage sources external to the converter chip. They are typically formed on the printed circuit board using adequately filtered and compensated voltage supplies.

A fully integrated alternative approach adopted in prior art devices is illustrated in FIG. 3. Referring to FIG. 3, the reference voltages are generated from the supply voltage using a resistive divider and are buffered by low noise amplifiers. However, inaccurate voltage values are obtained and the rejection of supply noise may be ineffective. The value of an integrated resistance is defined with a precision of only about ±15%.

In addition, since these integrated circuits are often a mix of digital and analog components, the voltage supply lines are affected by digital noise correlated to the clock frequency of the digital circuitry. Accordingly, it is not uncommon for amplitudes of several tens of mV (RMS) of noise to be superimposed on the DC supply voltage (VCC), as well as on the reference voltages derived from it.

To filter this noise, large external capacitors (e.g., several tens of $\mu$F) are normally used. However, this adds to the total cost of the application. Another drawback of this particular approach is the thermal drift of the reference voltages caused by temperature variations of the integrated resistors (polysilicon or "well" type).

Many integrated devices have circuits that generate reference voltages of adequate value either by the use of resistive voltage dividers or by the use of analog multipliers. These reference voltages originate from an on-chip generation of the bandgap voltage for the silicon (approximately 1.2–1.3 V) which is constant with temperature.

When generating symmetrical reference voltages for the peculiar applications mentioned above, their dependence on the temperature must be minimized and the rejection of noise superimposed on the supply voltage must be maximized. In addition, the voltages must not be overly sensitive to undesired conditions that may arise due to the inevitable spread of the nominal voltage values of the integrated components. Also, resistivity of interconnections may cause voltage differences due to undesired voltage drops, etc.

SUMMARY OF THE INVENTION

A circuit provides for the generation of temperature compensated low noise symmetrical reference voltages that effectively overcome the above mentioned problems and drawbacks of known circuits.

According to the present invention, these results are obtained by a circuit having a first stage that converts a voltage independent of the temperature into a current. Typically, the independent voltage is produced by a normal bandgap circuit wherein the current is applied to an integrated resistor coupled to ground (thus becoming sensitive to the change of temperature). A cascade of current mirrors derive from the current a differential pair of currents whose value is a replica of the value of the current through the integrated resistor. The replica currents are immune to the noise superimposed on the supply voltage, but are sensitive to thermal changes.

A pair of resistor feedback operational amplifiers have their noninverting input connected in common to a temperature compensated voltage. For example, the temperature compensated voltage is the same voltage produced by the bandgap circuit. The respective inverting inputs each receive one of the currents of the differential current pair. Symmetrical voltages are provided at the outputs of the operational amplifiers. These symmetrical reference voltages produced by the circuit are not susceptible to the noise that may be superimposed on the supply voltage. Such noise is also reduced by the rejection ratio of the PSRR for the two operational amplifiers.

Induced changes dependent on the temperature are effectively compensated by integrating the feedback resistors of the pair of output operational amplifiers in an interlaced manner to the first resistor. Temperature induced changes are inevitably reintroduced on the current forced through the integrated first resistor connected to ground. Therefore, all these integrated resistors will have substantially the same temperature gradient, which is compensated by the resistive ratio between the feedback resistors and the first resistor.

DETAILED DESCRIPTION OF THE PREFERRED EMBODIMENTS

Figure 1:
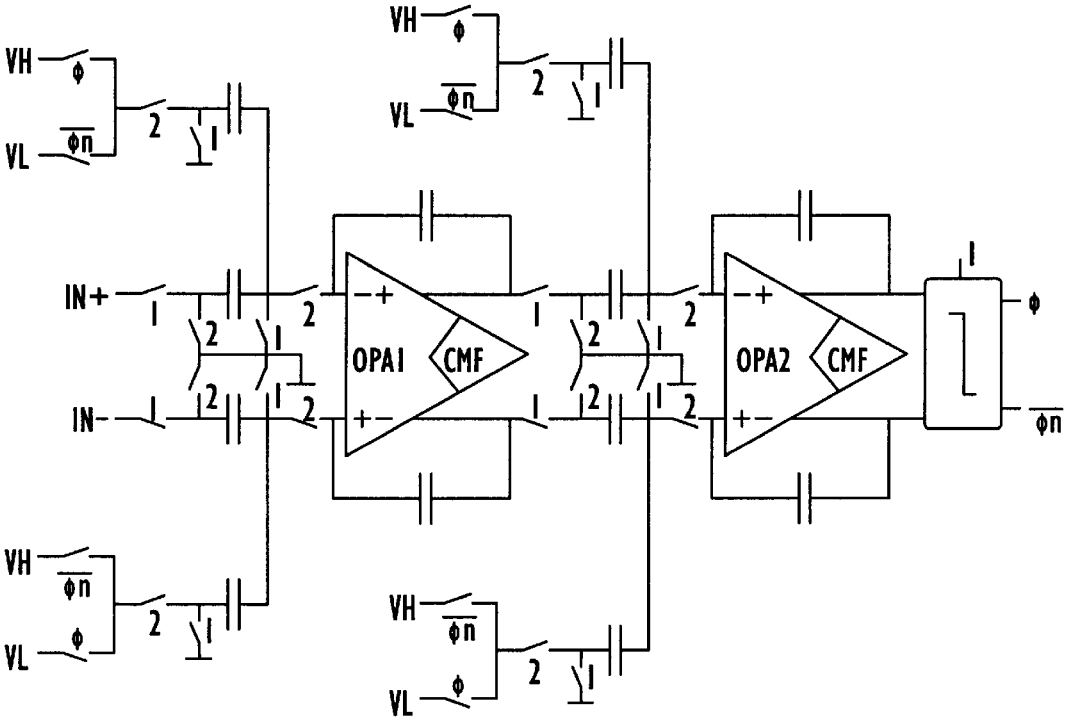
FIG. 1 PRIOR ART
FIG. 1 illustrates a prior art circuit diagram for a second order Sigma-Delta modulator for an A/D converter.
Figure 2:
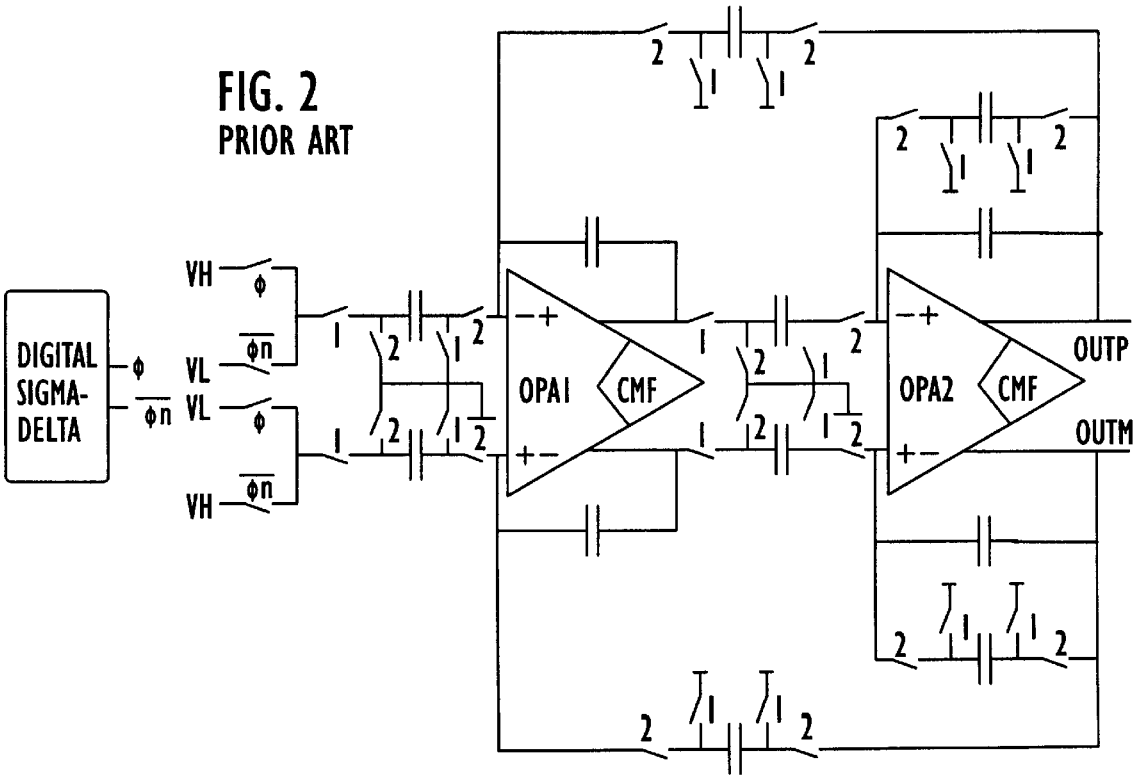
FIG. 2 PRIOR ART
FIG. 2 illustrates a prior art circuit diagram for a noise-shaping biquadratic filter cell for a D/A converter.
Figure 3:
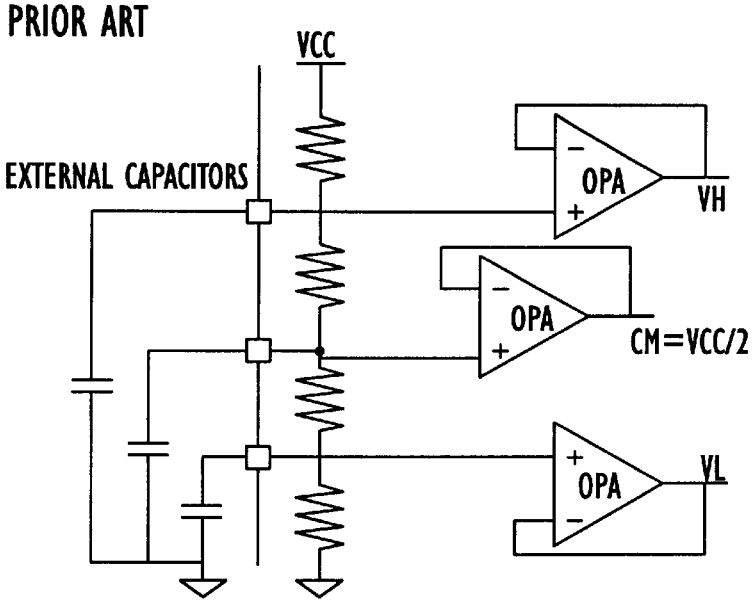
FIG. 3 PRIOR ART
FIG. 3 illustrates a prior art circuit diagram for generating symmetrical reference voltages with respect to an analog ground.
Figure 4:
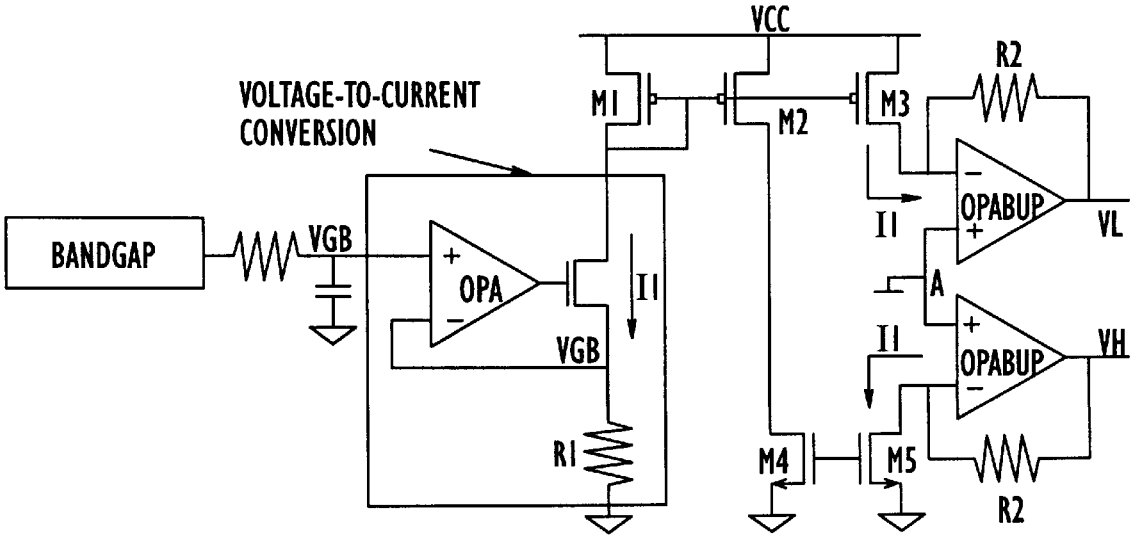
FIG. 4 illustrates a circuit diagram for generating two symmetrical voltages according to the present invention.

An embodiment of a circuit according to the invention for generating two symmetrical voltages VH, VL is shown in FIG. 4. Using a low-noise and temperature independent reference voltage VBG, a voltage-to-current conversion is performed by a low-noise, buffer-configured operational amplifier OPA and an integrated resistor Rl. The reference voltage VGB, for example, is generated by a common bandgap circuit integrated on the chip or derived from an external source via a dedicated pin.

The current generated is:

$$I1=VBG/R1$$

As indicated by this conversion, the current I1 is sensitive to the temperature drift of the absolute value of R1. However, the current I1 remains substantially immune to noise on the supply voltage. Such noise is attenuated according to the inherently high Power Supply Rejection Ratio (PSRR) of the operational amplifier OPA.

The generated current is duplicated using a plurality of current mirrors connected in cascade, as depicted in FIG. 4 by the MOS transistors M1–M5. This cascade of current mirrors generates a differential pair of currents I1. In other words, a duplicate is generated of the same current I1 forced through the integrated resistor R1 of the voltage-to-current conversion stage.

Any noise that is eventually superimposed on the DC supply voltage VCC does not distort the "copying" of the current from the first (input) branch M1 to the two following (output) branches M2, M3. This is because the noise is applied equally to the source nodes of the output transistors M2, M3 which have their gates in common. The gate-source voltage (VGS) is identical for M1, M2 and M3. Furthermore, electronic noise and any physical mismatch of the transistors may be reduced to negligible values simply by incrementing the channel length and the gate area.

The differential pair of currents are respectively applied to or received from (depending on their sign) the inverting input node of a pair of resistor feedback operational amplifiers so that the two operational amplifiers output the two symmetrical voltages VH, VL. These voltages are generated with respect to the voltage VA of the analog ground node A, which may, for example, coincide with the temperature independent voltage VBG.

The two operational amplifiers OPABUF1 and OPABUF2 "uncouple" the output symmetric voltages from the noise on the supply node by significantly attenuating the voltages as a function of the PSRR factor of the operational amplifier. Apart from functioning as a buffer for the circuits coupled to their outputs, the two operational amplifiers function as a switched-capacitor filter.

Therefore, VH and VL take the following values:

$$VH=VA+I1*R2$$

$$VL=VA-I1*R2$$

By setting VA=VBG and using the preceding relation for I1, the following equations are obtained:

$$VH=VBG+VBG*R2/R1$$

$$VL=VBG-VBG*R2/R1$$

According to this generation scheme of VH and VL, thermal compensation is easily implemented. This is accomplished in addition to retaining a substantial rejection of the supply noise. Resistors R1 and R2 are selected according to the same interlaced physical layout to exhibit the same thermal gradient. The thermal gradient is compensated by the ratio R2/R1.

Furthermore, dependence of the VH and VL voltages on a resistive ratio has the advantage of reducing the effects from differences in the physical implementation (process spread) of the resistors. With the circuit of the invention, accuracies of ±1% on the actual value of VH and Vl may be easily attained, even with a residual superimposed noise of only a few microvolts RMS.

That which is claimed is:

1. A generator circuit for generating temperature compensated low noise symmetrical reference voltages about an intermediate voltage, comprising:

a bandgap circuit for generating a temperature independent voltage;

a voltage-to-current conversion stage comprising a buffer-configured operational amplifier having a noninverting input coupled to the temperature independent voltage, a transistor driven by an output of the operational amplifier, and a first resistor connected between the transistor and a node of the generator circuit, a plurality of current mirrors connected in cascade for producing a differential pair of currents that are a replica of a current in the first resistor;

a pair of operational amplifiers and a pair of feedback resistors connected thereto, said pair of operational amplifiers having respective noninverting inputs connected together and to the temperature independent voltage, and respective inverting inputs connected to the differential pair of currents so that an output of each operational amplifier generates a reference voltage that is symmetrical to the other generated reference voltage; and the first resistor being interlaced with the feedback resistors.

2. A generator circuit according to claim 1, wherein the plurality of current mirrors comprises a first current mirror and a second current connected in cascade.

3. A generator circuit according to claim 2, wherein the first current mirror comprises a first, a second and a third transistor connected in cascade between an output of the voltage-to-current conversion stage for providing a replica current to the inverting input of one of said operational amplifiers.

4. A generator circuit according to claim 3, wherein the second current mirror comprises a fourth and a fifth transistor connected in cascade between an emitter of the second transistor for providing a replica current to the inverting input of the other said operational amplifier.

5. A generator circuit according to claim 3, wherein the first, second and third transistors have gates connected together and each of the first, second and third transistors have sources connected together.

6. A generator circuit according to claim 1, wherein a selected ratio of the feedback resistors to the first resistor compensates a difference in temperature gradients of said resistors.

7. A generator circuit according to claim 1, wherein said pair of feedback operational amplifiers function as a switched-capacitor filter.

8. A generator circuit for generating temperature compensated low noise symmetrical reference voltages, comprising:

a voltage-to-current conversion stage for generating a current which is applied to a first resistor;

a cascade of current mirrors for producing a differential pair of currents that are a replica of the current in the first resistor; and a pair of operational amplifiers and a pair of feedback resistors connected thereto, said pair of operational amplifiers having respective noninverting inputs connected together and to the temperature independent voltage, and respective inverting inputs connected to the differential pair of currents so that an output of each operational amplifier generates a reference voltage that is symmetrical to the other generated reference voltage; and the first resistor being positioned adjacent the feedback resistors.

9. A generator circuit according to claim 8, further comprising a bandgap circuit for generating a temperature independent voltage applied to an input of the voltage-to-current conversion stage.

10. A generator circuit according to claim 8, wherein a temperature independent voltage provided from an external source is applied to an input of the voltage-to-current conversion stage.

11. A generator circuit according to claim 8, wherein the voltage-to-current conversion stage comprises:

a buffer-configured operational amplifier; and a transistor driven by an output of the operational amplifier.

12. A generator circuit according to claim 8, wherein the cascade of current mirrors comprises a first current mirror and a second current.

13. A generator circuit according to claim 12, wherein the first current mirror comprises a first, a second and a third transistor connected in cascade between an output of the voltage-to-current conversion stage for providing a replica current to the inverting input of one of said operational amplifiers.

14. A generator circuit according to claim 13, wherein the second current mirror comprises a fourth and a fifth transistor connected in cascade between an emitter of the second transistor for providing a replica current to the inverting input of the other said operational amplifier.

15. A generator circuit according to claim 13, wherein the first, second and third transistors have gates connected together and the first, second and third transistors have sources connected together.

16. A generator circuit according to claim 8, wherein a selected ratio of the feedback resistors to the first resistor compensates a difference in temperature gradients of said resistors.

17. A generator circuit according to claim 8, wherein said pair of feedback operational amplifiers function as a switched-capacitor filter.

18. A method for generating temperature compensated low noise symmetrical reference voltages, comprising the steps of:

converting a temperature independent voltage into a current which is applied to a first resistor;

producing a differential pair of currents that are a replica of a current in the first resistor;

applying a thermally independent voltage to respective noninverting inputs of a pair of feedback operational amplifiers each having a feedback resistor connected thereto;

applying the differential pair of currents to respective inverting inputs of the pair of feedback operational amplifiers; and generating at an output of each operational amplifier a reference voltage that is symmetrical to the other generated reference voltage, and the first resistor being positioned adjacent the feedback resistors.

19. A method according to claim 18, wherein the step of converting a temperature independent voltage into a current comprises the steps of:

applying the temperature compensated voltage to a noninverting input of a buffer-configured operational amplifier; and driving a transistor by an output of the operational amplifier for generating the current.

20. A method according to claim 18, wherein the step of producing a differential pair of currents is produced using first and second current mirrors connected in cascade.

21. A method according to claim 18, further comprising the step of generating the temperature independent voltage from a bandgap circuit.

22. A method according to claim 18, further comprising the step of generating the temperature independent voltage from an external source.

23. A method according to claim 18, further comprising the step of selecting a ratio of the feedback resistors to the first resistor for compensating for any difference in temperature gradients of said resistors.

* * * * *